US005542228A

United States Patent [19]

Hagens

[11] Patent Number: 5,542,228

[45] Date of Patent: Aug. 6, 1996

[54] TIEING DEVICE MADE OF WIRE FOR CONNECTING REINFORCING RODS FOR CONCRETE CONSTRUCTIONS

[75] Inventor: Peter Hagens, Støvring, Denmark

[73] Assignee: Hagens Fiedre K/S, Støvring, Denmark

[21] Appl. No.: 29,595

[22] Filed: Mar. 11, 1993

[30] Foreign Application Priority Data

Mar. 11, 1992 [DK] Denmark ..... 326/92
Sep. 14, 1992 [DK] Denmark ..... 1128/92

[51] Int. Cl.[6] ..... E04C 5/16; E04G 21/12

[52] U.S. Cl. ..... 52/712; 52/715; 52/719; 24/370

[58] Field of Search ..... 52/712, 719, 715; 24/370, 698.3

[56] References Cited

U.S. PATENT DOCUMENTS 751,427 2/1904 Bossyns ..... 52/719
762,479 6/1904 Kampmann ..... 52/719
836,619 11/1906 Tosy ..... 52/719
919,099 4/1909 Wedmore ..... 52/719
1,185,263 5/1916 Symons ..... 52/719
1,263,887 4/1918 Hamilton ..... 52/719
1,650,485 11/1927 Blank ..... 52/712 X
2,843,230 8/1958 Nelsson ..... 52/719
3,257,767 6/1966 Lassy ..... 52/712 X

FOREIGN PATENT DOCUMENTS 919606 10/1954 Germany .
453607 2/1988 Sweden .

*Primary Examiner*—Wynn E. Wood
*Attorney, Agent, or Firm*—Antonelli, Terry, Stout & Kraus

[57] ABSTRACT

A tieing device in the form of a wire element preferably made of spring steel consists of a straight piece of wire with an elbow and two hooks facing in opposite directions. The wire element is simple and inexpensive to manufacture and furthermore simple to apply. Fitting the wire elements uses a particular oblique placement of a wire-element magazine and two plungers, one of which displaces the wire element sideways and the other subsequently pushes one hook under one of the reinforcing rods.

9 Claims, 4 Drawing Sheets

TIEING DEVICE MADE OF WIRE FOR CONNECTING REINFORCING RODS FOR CONCRETE CONSTRUCTIONS

BACKGROUND OF THE INVENTION

1. Field of the Invention

The present invention is generally related to a tieing device made of wire for connecting reinforcing rods for concrete constructions as well as apparatus for use in applying such devices.

2. Description of the Prior Art:

From SE-FS 453 607 such a device is known for tieing reinforcing rods, but it is fairly complicated to manufacture and in consequence expensive.

From U.S. Pat. No. 1263 887 a wire clip is known, the ends of which grips one reinforcing rod and the middle part grips the crossing reinforcing rod. The wire is bent into a quite complex shape, but the retaining ability of this wire clip is not sufficient, because of the need for a fairly large distance between the points of attack of this clip.

From DE-B 919 606 a spring clip of simple shape is known which according to one embodiment consists of a straight piece joining two hooks. The patent states that the shape of the hook parts is unimportant, and the retaining ability of this spring clip is entirely dependent on the stiffness of the straight piece. Also the fitting of the spring clip is difficult because the straight piece has a tendency to turn during application.

OBJECTS OF THE INVENTION

Accordingly, it is an object of the invention to provide a unique tieing device which displays none of the disadvantages mentioned above and which is simple to apply and which has great strenght in holding reinforcing rods together.

It is another object of the invention to provide a unique type of apparatus for fitting such tieing devices to reinforcing rods at their intersections.

It is a further object of the invention to provide a grid consisting of intersecting reinforcing rods fitted with tieing devices of the type specified herein.

BRIEF DESCRIPTION OF THE DRAWINGS

FIGS. 9, 12, 13, and 14 are side views, while

According to the invention it has been realized that an improved result may be obtained with a simple device made of one piece of wire. Known devices have not made use of positive friction between the clips and the reinforcing rods. The wire element according to the invention is particular in that it consists of a piece of wire with the ends bent into hooks on either side thereof and by providing the wire element with an elbow midway between the ends. This has the advantage that the wire element becomes self-centering whereby fitting becomes easier.

In a preferred embodiment the very ends of the wire are straight pieces continuing the circular hooks into tangents including an angle between the central part and the tangent. If the outer ends of the bends are not made long enough they may lose the grip around the reinforcing rod during handling of the reinforcement or the subsequent pouring of the concrete and the vibration.

An improved grip may be obtained in further preferred embodiment by letting the relaxed radius of curvature of the hook be slightly smaller than half the diameter of the reinforcing rod it has to grip.

In a further preferred embodiment the hooks are shaped to take an elliptical shape when gripping the reinforcing rod. This elliptical shape is derived from the elliptical section of a plane cutting a cylinder at an oblique angle.

The element is preferably made of spring steel but may also be made of a suitable plastic material. Technically the element is simple to manufacture because it may be made in one operation, and consequently it is also inexpensive.

The wire element is fitted by threading one bend about a reinforcing rod and over the crossing reinforcing rod which is to be secured and by pushing the other bend about the first reinforcing rod.

An apparatus according to the invention for use in fitting the wire element carrying a magazine for holding a number of such wire elements is particular in that the magazine is disposed at an angle and is turned around its longitudinal axis in order that the wire element which is prepared for fitting has one end disposed in a level below the lower reinforcing rod, and in that the wire element is disposed across the rods, so that the other end of the wire element is disposed in a level above the lower reinforcing rod, and in that it comprises a first plunger for sideways movement of the wire element out of the magazine and with the lower end of the wire element below the reinforcing rod, and the upper end above and to the side of the rod, whereby a second plunger controlled by a roller in guideways provides a push on the upper end of the wire element below the lower reinforcing rod.

DETAILED DESCRIPTION OF THE PREFERRED EMBODIMENT

Figure 1:
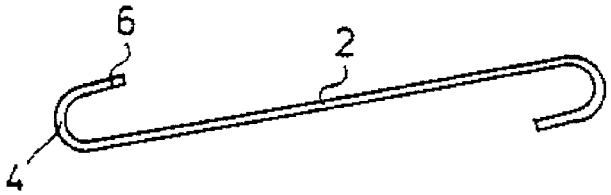
FIG. 1 shows a wire element according to a first embodiment of the invention.

Referring to FIG. 1, there is shown a first embodiment of the invention, which is a wire element made of spring steel. The wire element comprises a straight central piece 2 which at the ends changes into hook-shaped bends 4 which are disposed in the same plane as the body. The hooks are semi-circular and end with a straight piece 6 which is disposed at an angle to the central piece.

Figure 2:
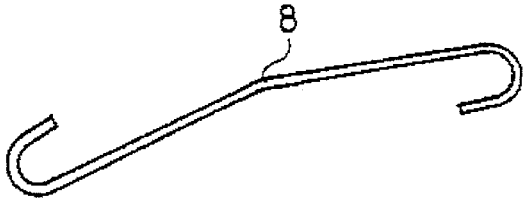
FIG. 2 shows a wire element according to another embodiment of the invention.
Figure 3:
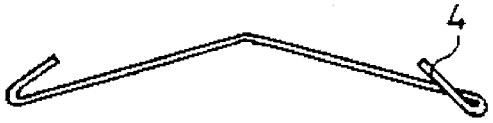
FIG. 3 shows a wire element according to a third embodiment of the invention.

A slightly different embodiment is shown in FIG. 2 which is distinguished from the embodiment shown in FIG. 1 by an elbow 8 at the mid-point of the central piece 2. Thereby the two parts of the central piece and the hooks lie in planes which intersect on a line through the point 8. In this manner the application of the wire element is facilitated.

The hooks have to have a certain minimum length in order not to lose the grip during the further handling of the reinforcement and pouring and vibration of the concrete. By bending the hooks. 4 out of the plane comprising the central piece they will obtain a larger contact area with the reinforcing rod.

Figure 4:
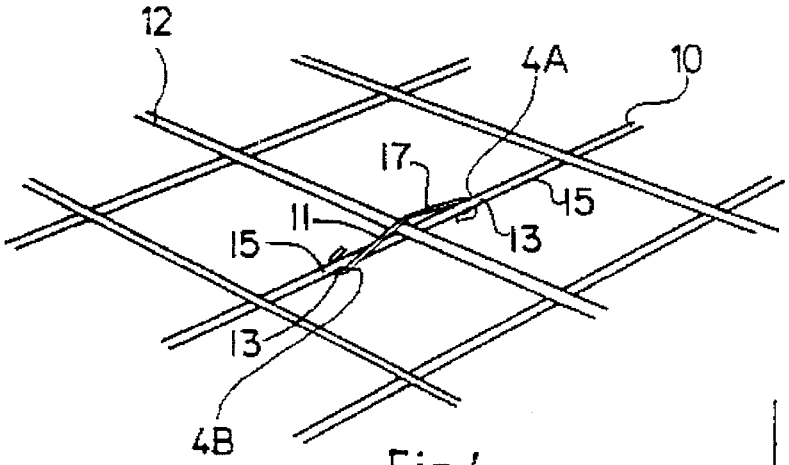
FIG. 4 shows a section of a grid of reinforcing rods with a node connected by means of a wire element as shown in FIG. 2.

In FIG. 4 is shown a section of a reinforcing grid which two reinforcing rods 10 and 12 being tied with a wire element as shown in FIG. 2. One end 4A of the wire element is threaded around the reinforcing rod 10, so that it crosses the other reinforcing rod 12. By pressing down on the other end 4B of the wire element it will center itself with the elbow situated on the crossing reinforcing rod 12. The end 4B is brought down adjacent to the reinforcing rod 10 and is displaced sideways below it in order that the hook springs up around the rod 10 when it is released. The fitting is quite simple to perform. As illustrated the straight parts of the tieing device intersect the reinforcing rod 10 at points offset from the intersection between the reinforcing rods 10 and 12. The point of intersection of the straight parts with the reinforcing rod 10 is a vertex 13 of an oblique angle formed with a first leg being the extension 15 of the reinforcing rod away from the point of intersection and the second leg being a straight part 17 of the tieing device.

Figure 5:
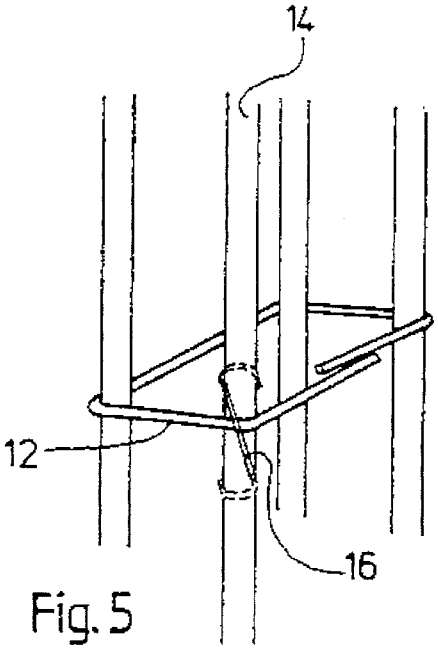
FIG. 5 shows a section of a pillar reinforcement where a reinforcing bracket is secured by means of a wire elements as shown in FIG. 2.

The wire element also be used for tieing a pillar reinforcement as shown in FIG. 5, where a reinforcing bracket 12 is fixed to a reinforcing rod 14 by means of a wire element 16 of the type shown in FIG. 2.

Figure 6:
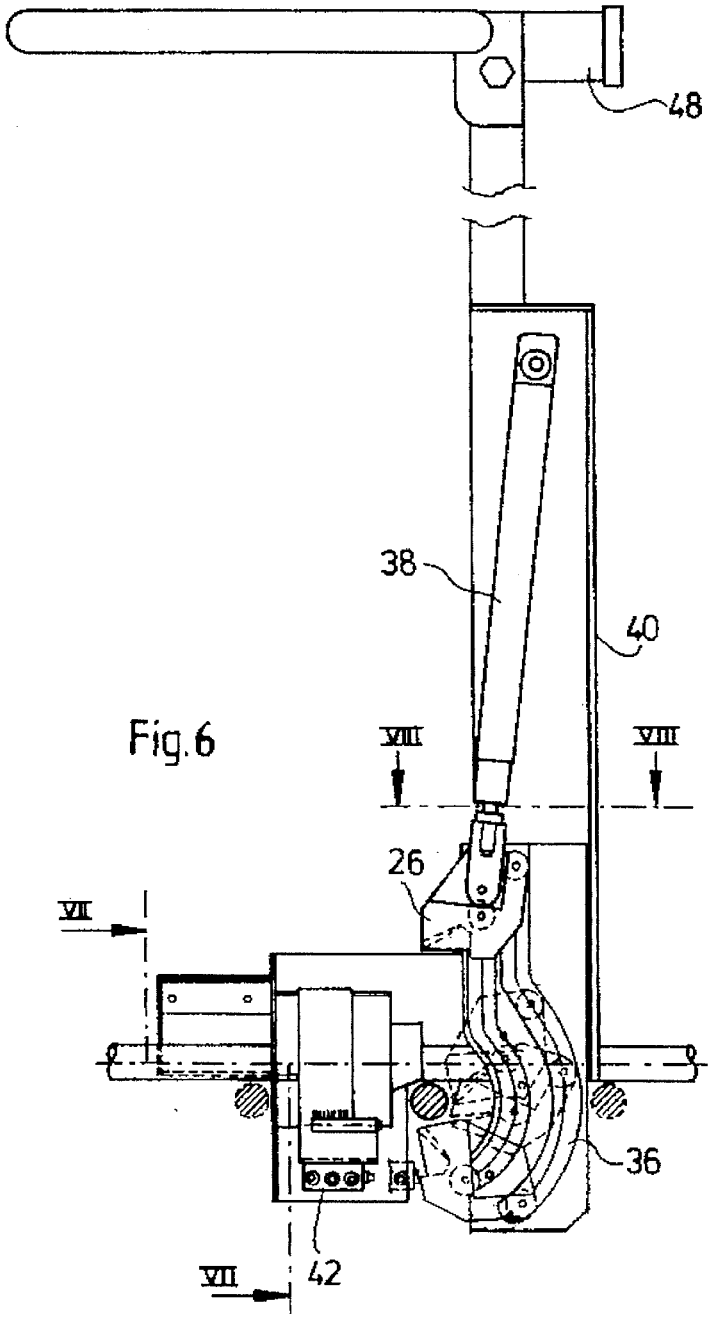
FIG. 6 shows an apparatus for applying the wire elements, without magazine and cover, section VI—VI of FIG. 8.
Figure 8:
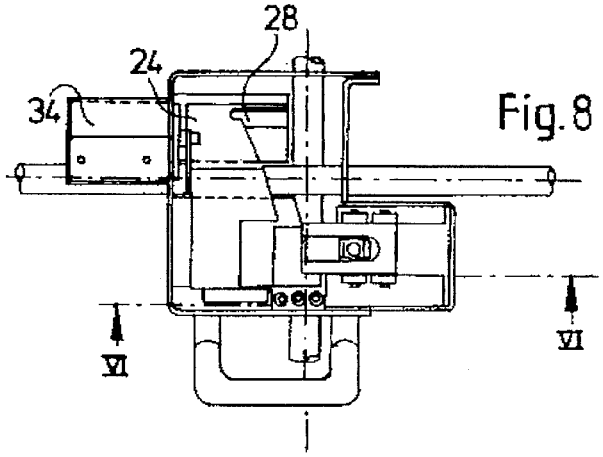
FIG. 8 shows a section of the apparatus, section VIII—VIII of FIG. 6, FIGS. 9–14 show a wire element during the application to two perpendicularly crossing reinforcing rods, where
Figure 7:
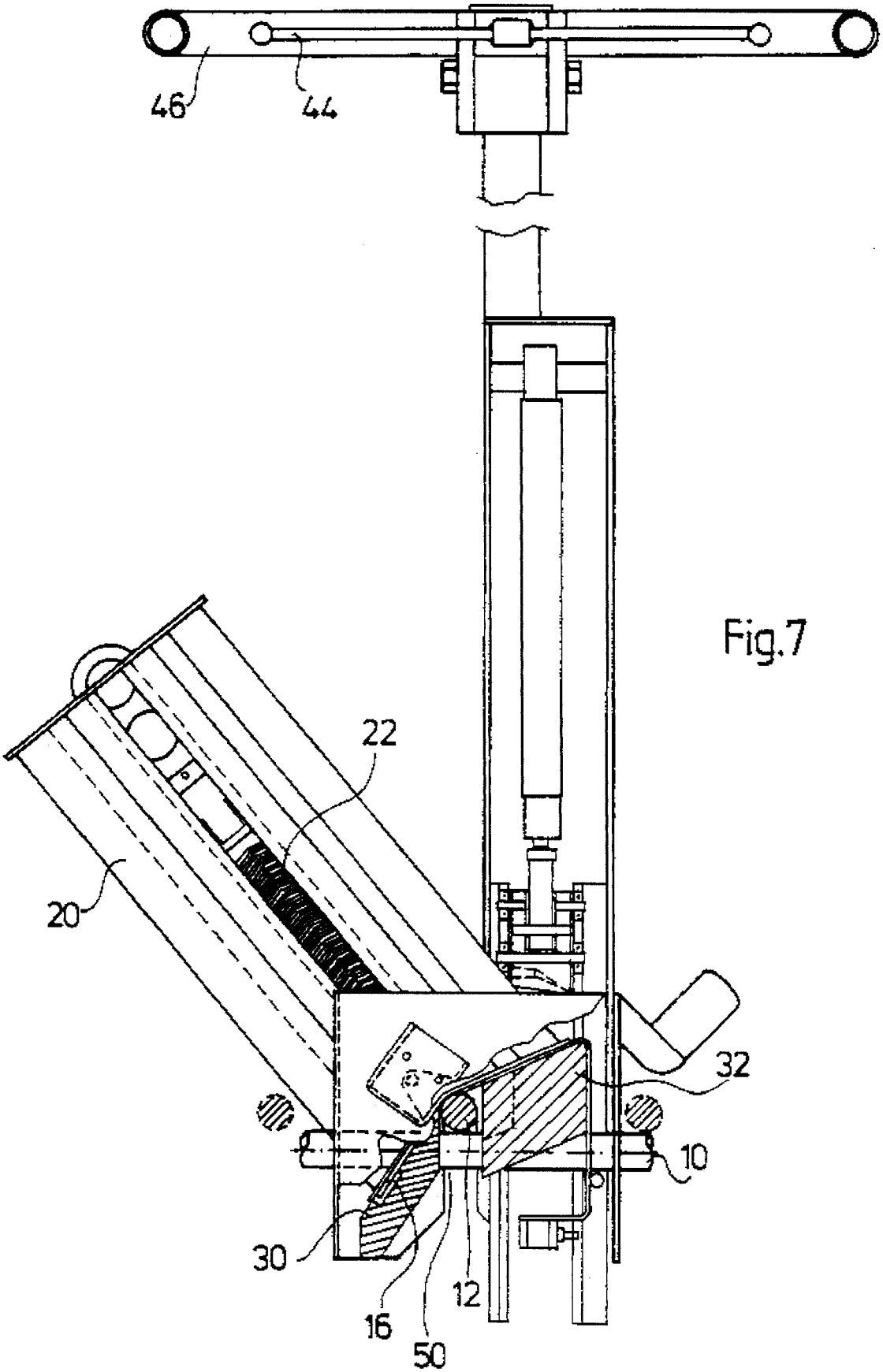
FIG. 7 shows the apparatus seen from behind, with magazine fitted, section VII—VII of FIG. 6.

An apparatus for fitting the embodiment of the wire element shown in FIG. 2 is shown schematically in FIGS. 6–8. The apparatus is based on the wire elements being supplied in "clips" of a specific length, i.e. the wire elements are connected to each other in a long row in a known manner, e.g. by means of a varnish or glue. The apparatus comprises a magazine 20 for such "clips" of binders. In FIG. 7 the magazine is shown loaded with such a "clip" 22 of binders which is loaded into the magazine from one end and which is urged forward by a spring as is well known in this type of magazine.

Figure 9:
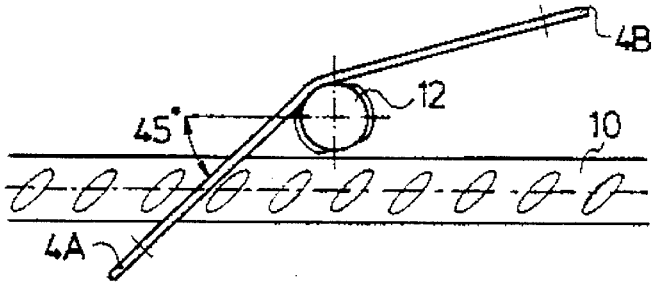
Figure 10:
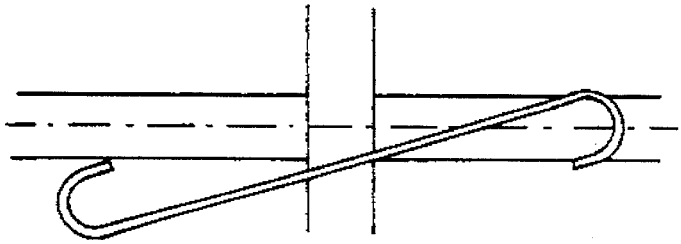
FIGS. 10 and 11 are top views.

The wire elements are fitted by a combination of the position of the magazine with respect to the placement of the apparatus on the reinforcement and two plungers 24, 26. Apart from having an oblique position as shown in FIG. 7 the magazine 20 is turned whereby the wire elements receive the starting position shown in FIGS. 9 and 10, where the wire element in FIG. 9 is seen from the side and in FIG. 10 from above. The wire element is disposed obliquely corresponding to the position of the magazine so that one end 4A with the hook is at a level below the lowermost reinforcing rod 10, and the other end 4B is at a level which is above the topmost reinforcing rod 12. The wire element is as yet quite unstressed. The bottom end 4A of the wire element is furthermore displaced sideways with respect to the bottom reinforcing rod 10. The rotation of the magazine about its longitudinal axis is adjusted in order that upper end 4B of the wire element is disposed more or less directly above the rod 10. This corresponds to the slanted end 28 of the plunger 24.

The wire elements are expelled through the mouth of the magazine against two slide plates 30 and 32 shown in FIG. 7, where a wire element 16 is shown in place. The wire element is furthermore supported by the edge 28 of the plunger 24. The plunger 24 may be brought forward by means of a pneumatic cylinder 34 whereby the wire element 16 is broken loose from the "clip" 22 and sideways displaced to the position shown in FIG. 9 but where the bottom end 4A is pushed under the lower reinforcing rod 10, while the upper end 4B is pushed sideways. The wire element itself is still not stressed mechanically, and the angular position is the same as before.

Figure 11:
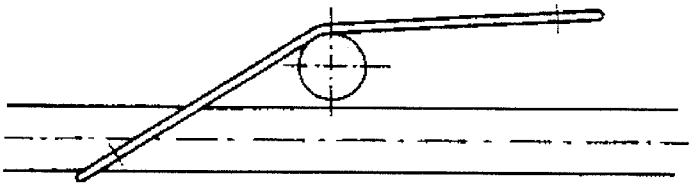
Figure 12:
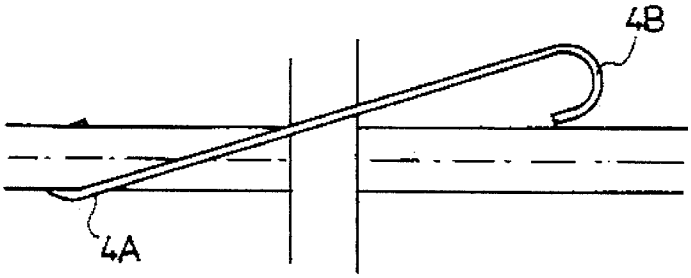
Figure 13:
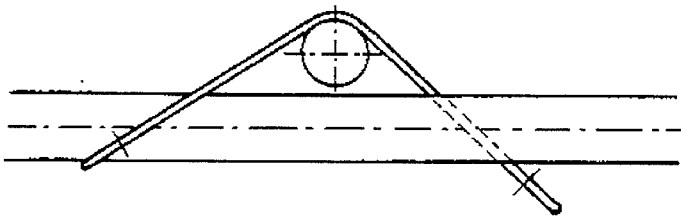
Figure 14:
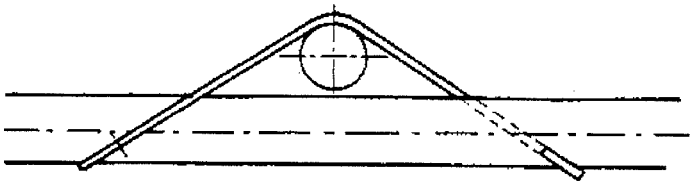

The movement of the second plunger 26 is controlled by means of rollers in guideways 36 on both sides. The plunger 26 is moved by means of a pneumatic cylinder 38 in the handle 40 of the apparatus. In FIG. 6 the plunger is shown in its starting position in broken lines where the upper end 4B of the wire element is pushed under the plunger corresponding to the position shown in FIG. 11. By activating the pneumatic cylinder the plunger 26 will press against the upper end 4B which initially will cause the wire element to pivot on the upper reinforcing rod 12 so that the bottom hook 4A grips the lower reinforcing rod 10 as shown in FIGS. 11 and 12. In its further movement the plunger 26 will start a rotation caused by the guideway and push the end 4B of the wire element below the reinforcing rod 10 to the position shown in FIG. 13. At maximum extent of the travel of the plunger 26 the end 4B will spring upwards to engage the reinforcing rod 10. The two reinforcing rods 10 and 12 are thus linked at their point of intersection.

In its final position a protruding end of the plunger 26 actives a pneumatic valve 42 mounted on the other plunger which causes the plungers to reverse to their starting position. In FIG. 6 the valve 42 is shown in its forward position in broken lines, with the plunger 26 at its maximum extent shown in unbroken lines.

The apparatus is controlled by an activating lever 44, shown in FIG. 7. At the end of the handle 40 there is a frame 46, and a pneumatic valve 48 controlled by the lever 44 may be reached from the frame.

The bottom end of the apparatus has two slots 50 at right angles to each other in order that the apparatus may be placed over intersecting reinforcing rods 10, 12. The entry to the slits define an angular space between them in order that the apparatus will find the correct position while engaging the reinforcing rods.

The apparatus described above is simple to use and durable, and it ensures a secure fitting of the wire elements.

Even quite small improvements and savings have a large influence, because a large number of ties have to be made even in fairly simple constructions of reinforced concrete, and in the case of e.g. large bridge constructions the influence on cost are dramatic.

To illustrate the need for improvement it should be mentioned that although a number of spring clips of similar types are known, tieing with simple iron wire is still widely performed because the known spring clips are relatively expensive and difficult to fit. These problems have been solved by the present invention.

What I claim is:

1. A tieing device made of wire for use in connection of reinforcing rods for concrete construction comprising:

two straight portions and an elbow disposed in a single plane with the two straight portions being connected at the elbow with the two straight portions and the elbow forming an obtuse angle and each straight portion having a remote end spaced from the elbow; and two hook-shaped ends respectively disposed at the remote ends of the two straight portions and projecting out of the plane, said hook shaped ends facing oppositely each other.

2. A tieing device in accordance with claim 1 wherein the hook-shaped ends each comprise:

a circular hook and a straight piece continuing from the circular hook.

3. A tieing device in accordance with claim 2 wherein:

a radius of curvature of each circular hook is smaller than half a diameter of a reinforcing rod to which the tieing device is to be attached.

4. A tieing device according to claim 1 wherein:

the hook shaped ends are pre-formed to have an essentially elliptical shape when connected to one of a pair of reinforcing rods.

5. A tieing device according to claim 1 wherein:

the straight portions are of substantially equal length.

6. A tieing device according to claim 2 wherein:

the straight portions are of substantially equal length.

7. A tieing device according to claim 3 wherein:

the straight portions are of substantially equal length.

8. A tieing device according to claim 4 wherein:

the straight portions are of substantially equal length.

9. A reinforcing grid for concrete construction in accordance with any one of claims 1–8 comprising:

a plurality of reinforcing rods contacting each other in a grid with the reinforcing rods of the grid being connected together with a plurality of the tieing devices with the hook shaped ends of each tieing device engaging one reinforcing rod at spaced apart portions along the one reinforcing rod and the elbow engaging another reinforcing rod transverse to the one reinforcing rod with the one and the another reinforcing rod touching at a point of intersection adjacent the elbow.

* * * * *